US005842365A

United States Patent [19]

Bordonaro

[11] Patent Number: 5,842,365

[45] Date of Patent: Dec. 1, 1998

[54] COMPACT KEY RETAINING SYSTEM

[76] Inventor: Corrado Bordonaro, 36 Solway Court, Agincourt, Ontario, Canada, M1W 1S6

[21] Appl. No.: 729,577

[22] Filed: Oct. 11, 1996

[51] Int. Cl.[6] ..... A47G 29/10

[52] U.S. Cl. ..... 70/456 R; 70/457; 70/459; 206/37.1; 206/37.8; 206/38.1

[58] Field of Search ..... 70/456 R, 457, 70/458, 459, 460, 456 B; 24/3.6; 206/37.1, 37.2, 37.3, 37.4, 37.5, 37.6, 37.7, 37.8, 38.1

[56] References Cited

U.S. PATENT DOCUMENTS

| | | | |
|---|---|---|---|
| 1,815,209 | 7/1931 | Nikonow | 70/457 |
| 2,564,242 | 8/1951 | Wendt | 70/458 |
| 2,605,632 | 8/1952 | Lamonde | 70/456 R |
| 2,805,566 | 9/1957 | Martinuzzi | 70/456 R |
| 3,061,999 | 11/1962 | O'Brien | 70/458 |
| 3,119,429 | 1/1964 | Stiller et al. | 70/457 |
| 3,175,380 | 3/1965 | Ward | 70/456 R |
| 3,715,900 | 2/1973 | Sherman | 70/456 R |
| 3,916,659 | 11/1975 | Leopoldi | 70/456 R |
| 4,191,038 | 3/1980 | Vaughn | 70/457 |
| 4,281,527 | 8/1981 | Leopoldi et al. | 70/456 R |
| 4,379,394 | 4/1983 | Toyoda | 70/456 R |
| 4,976,124 | 12/1990 | Sanders | 70/458 |

FOREIGN PATENT DOCUMENTS

| | | | |
|---|---|---|---|
| 961011 | 1/1975 | Canada | 70/456 R |

*Primary Examiner*—Lloyd A. Gall
*Attorney, Agent, or Firm*—Neil H. Hughes; Ivor M. Hughes; Marcelo K. Sarkis

[57] ABSTRACT

A key-retaining system is provided which includes a key holder and a key holder retainer. The key holder is a substantially continuous member having ends and sides, for example one continuous wire, and provides an interior space between the sides and ends of the member. The ends are separated by a predetermined distance substantially greater than the length of a key. One of the sides or ends includes a device to permit fastening of keys upon the member. The key holder retainer includes a hollow extending substantially from end to end of the key holder retainer and adapted to receive the key holder in use. Keys may be fastened on the key holder and positioned in a flat position within the interior space of the key holder. The key holder retainer is then friction fit onto the key holder remote the key heads. In this position the tail end of the keys may be contained within the hollow of the key holder retainer within the interior space of the key holder in a flat package which may be comfortably stored by the user.

6 Claims, 3 Drawing Sheets

COMPACT KEY RETAINING SYSTEM

FIELD OF INVENTION

This invention relates to holders for keys and finds particular application to those key holders which are formed from one continuous member upon which keys are retained.

BACKGROUND OF THE INVENTION

Most individuals utilize a key ring for storing the important keys to which they require ready access. Others utilize a pouch containing a number of keys suspended on individual hooks fastened to one end of the pouch. A cover portion extends over the keys which is closed and allows the keys to lay flat in one's pocket. These pouches, however, are prohibitively expensive since they are made from leather, and the multiplicity of hooks fastened to one end of the pouch are essentially weak and easy to break. The key ring therefore has become the standard in the public's mind for storing keys. Often key fobs are included with the key ring.

Regardless of the size of the key ring, a basic problem exists, and that is that the keys do not lay flat in an individual's pocket, on a desk or other supporting surface. Therefore the desk can be scratched and the pocket can be punctured.

U.S. Pat. No. 4,191,038, issued Mar. 4, 1980, describes a key holder manufactured with a coil at one end to allow the isolation of one key from the balance of the keys. However, this reference does not provide for simple insertion and removal of the keys from the key holder, nor for a flat package which may be secured within an individual's pocket or purse, and which may alternatively be suspended from a user's belt or the like via a chain or other supporting filament.

U.S. Pat. No. 4,976,124, issued Dec. 11, 1990, describes a key holder and a method for holding keys. Of particular interest is the embodiment illustrated in FIG. 2 wherein keys may be placed in the position shown for insertion within a pocket. However, during the course of the day, as one is apt to move around considerably, the keys may not remain in the position shown in FIG. 2.

Nowhere within the prior art therefore, to Applicant's knowledge, is there found a key holder and key holder retainer which allows for keys to be stored in a flat array within an opening provided in the key holder, which may be retained in that position by a separate retainer placed over the tail end of a key held on the key holder to maintain the compactness of the key retainer when inserted in one's pocket or the like.

It is therefore a primary object of the invention to provide a key-retaining system which is simple to manufacture and easy to use which obviates many of the problems in the prior art.

It is a further object of this invention to provide a key holder which interfits with a key retainer to provide said key retaining system.

Further and other objects of the invention will become apparent to those skilled in the art when considering the following summary of the invention and the more detailed description of the preferred embodiments illustrated herein.

SUMMARY OF THE INVENTION

According to a primary aspect of the invention, there is provided a key-retaining system comprising a key holder and a key holder retainer, said key holder comprising a substantially continuous member having ends and sides, for example one continuous wire, and providing an interior space between the sides and ends of the member, said ends being separated by a predetermined distance substantially greater than the length of a key, one of said sides or ends including means to permit fastening of keys upon said member (such as an overlap joint), said key holder retainer including a second member having ends and sides and having a hollow disposed therewith, the hollow extending substantially from end to end of the key holder retainer and adapted to receive the key holder in use, wherein keys are fastened on said key holder and positioned in a flat position within the interior space of said key holder, and said key holder retainer is friction fit onto the key holder remote the key heads whereat the tail end of the keys may be contained within the hollow of said key holder retainer within the interior space of said key holder in a flat package which may be comfortably stored by the user. In a preferred embodiment of the invention, the key holder retainer includes an opening proximate one end thereof for fastening to a chain or other resilient element from which the key retainer may be secured (for example within a pocket attached to a belt loop, a belt, or the like, or alternatively within a purse or a brief case). In another embodiment of the invention, the key holder retainer may be made from thermoplastic material preferably which readily receives a message such as advertising material on the exterior surface thereof.

According to another aspect of the invention, there is provided a key-retaining system comprising a key holder and a key holder retainer, said key holder comprising a quadrilateral-shaped and preferably a rectangular-shaped member having two sides and two ends defined by a substantially continuous member, preferably said sides extending substantially parallel to one another and said ends extending substantially parallel to one another, for example one continuous wire, and providing an interior space between the sides and ends of the member, said ends being separated by a predetermined distance substantially greater than the length of a key, one of said ends or sides including means to allow fastening of keys upon said member (such as an overlap joint), said key holder retainer including a second member having two ends and two sides and having a hollow disposed therewith, said second member having an exterior surface, and an interior surface adjacent said hollow, the sides of the inside surface of said second member (preferably including a groove or channel proximate the sides of the key holder retainer) being separated by a predetermined distance substantially equal to or slightly greater than the distance between the sides of the key holder, the hollow extending substantially from end to end of the key holder retainer, wherein keys are fastened on said key holder and positioned in a flat position within the interior space between the sides of said key holder, and said key holder retainer is friction fit onto the end of the key holder remote the key heads whereat the tail end of the keys may be contained within the hollow of said key holder retainer within the space between the sides of said key holder in a flat package which may be comfortably stored by the user. In a preferred embodiment of the invention, the key holder retainer includes an opening proximate one end thereof for fastening to a chain or other resilient element from which the key retainer may be secured (for example within a pocket attached to a belt loop, a belt, or the like, or alternatively within a purse or a brief case). In another embodiment of the invention, the key holder retainer may be made from thermoplastic material preferably which readily receives a message such as advertising material on the exterior surface thereof.

DETAILED DESCRIPTION OF THE PREFERRED EMBODIMENTS OF THE INVENTION

Figure 1:
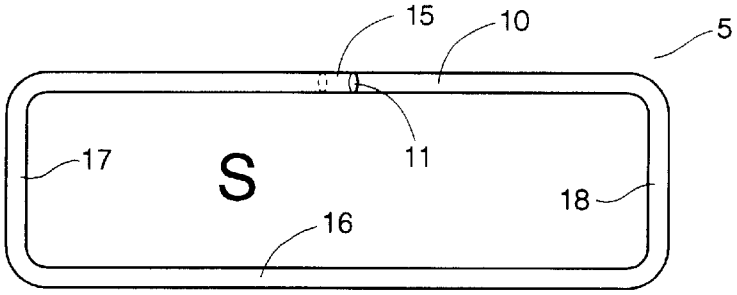
FIG. 1 is a front view of the key holder illustrated in a preferred embodiment of the invention.

Referring generally to the Figures, there is provided a key retaining system 5 including a key holder 10 and a key holder retainer 20. The key holder 10 is made up of 3/32" spring wire plated to custom specifications. The overall dimensions of the holder are not important, but at the present time, Applicant has two standard sizes, being 5/8" wide, center to center by 2½" long center to center with a ¼" overlap at the lap joint. As key lengths change, these overall dimensions may change accordingly as well. At the present dimensions, a total of seven keys may be held on the key holder.

The key holder 10 therefore includes two ends 17 and 18, and two sides 15 and 16. The outside dimensions of the holder 10 are 2 11/16" in length and 13/16" in width. The side 15 is discontinuous at a lap joint 11 which is substantially ¼". This lap joint is best seen in FIG. 3 and allows for simple insertion and removal of keys onto the key holder 10, without excessive effort or damage to the fingernails.

Figure 2:
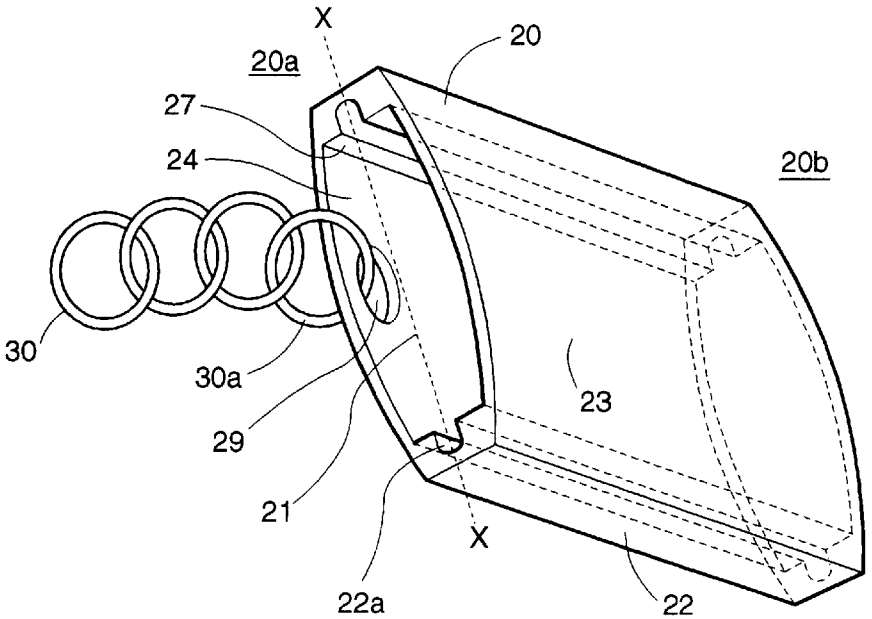
FIG. 2 is a perspective view of the key holder retainer illustrated in a preferred embodiment of the invention.
Figure 10:
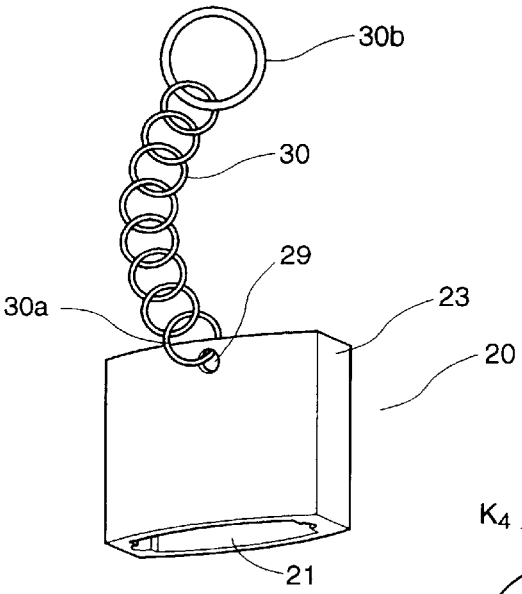
FIG. 10 is a front view of the key holder retainer of FIG. 2.
Figure 11:
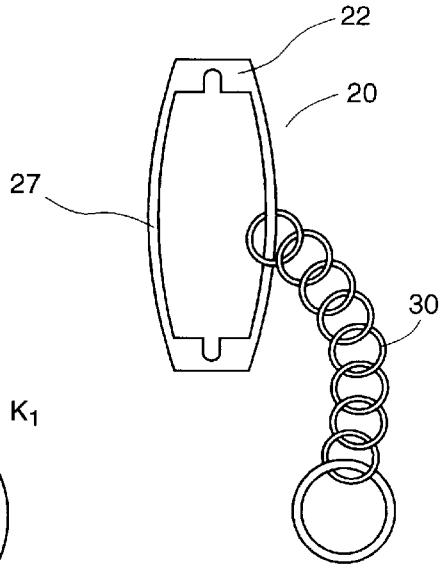
FIG. 11 is an end view of the key holder retainer of FIG. 2.
Figure 12:
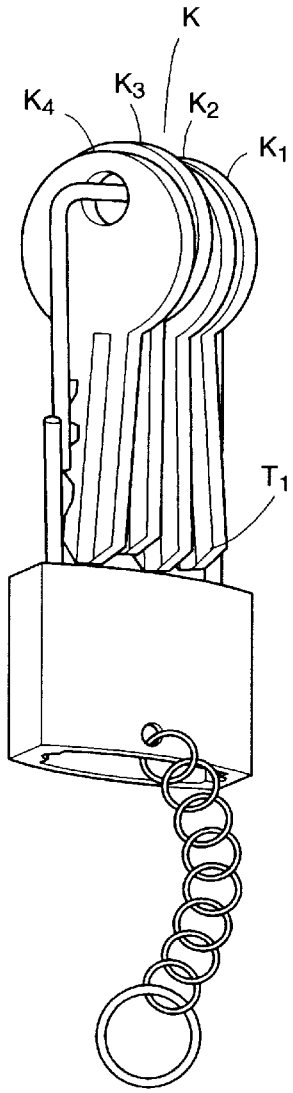
FIG. 12 is an assembled view of the key holder and key holder retainer wherein keys are carried illustrated in a preferred embodiment of the invention.

A key holder retainer 20 is also provided generally made from plastic material in the preferred embodiment and having a hollow 21 extending therethrough as best seen in relation to FIG. 11. A resilient member such as a chain 30 is provided as best seen in FIG. 10 including a link 30*a* engaged through an opening 29 of the key holder retainer 20. This chain 30 may be affixed to a belt loop, a briefcase, a purse or a school bag. The key holder retainer 20 includes an exterior surface 23 and an interior surface 27 which essentially defines the shape of the hollow. Disposed at the sides 22 of the key holder retainer 20 are grooves 22*a* formed within the inner surface 27 adjacent the hollow 21. These grooves 22*a* are separated by a distance 24 along the section X . . . X which is substantially equal to or slightly greater than 13/16" being the outer dimension of the ends 17 and 18. The grooves 22*a* extend substantially from one end 20*a* to the other end 20*b* of the key holder retainer as best seen in FIG. 2. The spring steel wire 10 therefore will friction fit within the grooves 22*a* snugly so as to present a tight package for any keys held on the key holder 10. This is best seen in relation to FIG. 12. The grooves are preferred but not necessary. In another embodiment, the grooves are omitted, and the sides of the hollow 21 are separated by a dimension equal to or slightly greater than the distance between the sides of the holder 10.

Figure 3A:
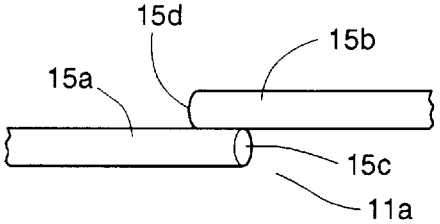
FIGS. 3A, 3B and 3C are alternative lap joint side views of the lap joint, seen in FIG. 1 and illustrated in various embodiments of the invention.
Figure 3B:
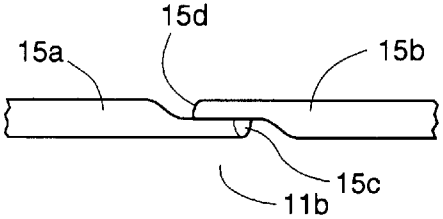
Figure 3C:
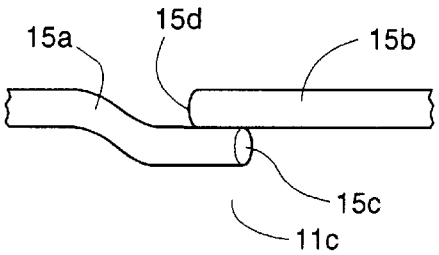
Figure 4:
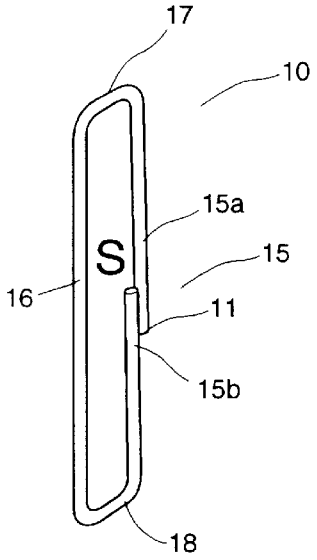
FIG. 4 is a perspective view of FIG. 1.
Figure 5:
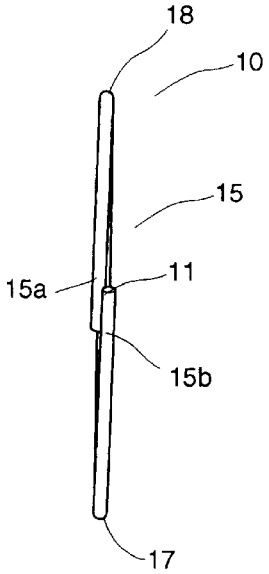
FIG. 5 is a side view of FIG. 4 when viewed from the end of the lap joint 11.
Figure 6:
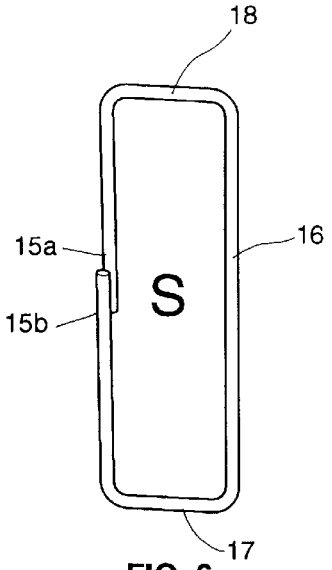
FIGS. 6 and 7 are front views similar to FIG. 1 showing both sides, top and bottom, of the key holder and illustrated in a preferred embodiment of the invention.
Figure 7:
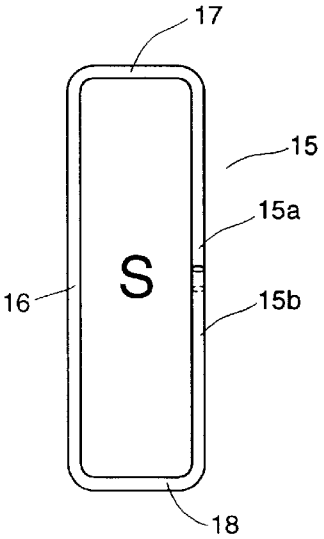

Referring now to FIG. 3, there is illustrated various forms which the lap joint 11, seen in FIG. 1, may take. The embodiments illustrated in all of the figures, with the exception of FIG. 3, illustrates lap joint 11*a*. The elements 15*a* and 15*b* which overlap may extend one above the other as seen in FIGS. 3*a* and 3*c*. Alternatively, the portions 15*a* and 15*b* making up the lap joints may extend in the same line as one another as seen in FIG. 3*b*. The differences of these joints resides in the but end 15*d* and 15*c* of FIGS. 3*a* and 3*c* wherein the but ends 15*c* and 15*d* act as stops when engaging the exterior wall of the material proximate the end 20*a* or 20*b* of the key holder retainer. When the key holder retainer is slid onto the wire 10, it may be slid up to the point where the end 20*a* or 20*b* buts up against the but end 15*c* or 15*d*. The key holder retainer is in its final position unless one of the portions 15*a* or 15*b* deflected to a substantially co-linear position to allow for continued insertion of the groove 22*a* of the retainer 20 on the wire 10. However, the embodiment of FIG. 3B allows for the key holder retainer 20 to be slid to any position desired. This becomes very desirable when short keys are being stored on the key-retaining system.

Figure 9:
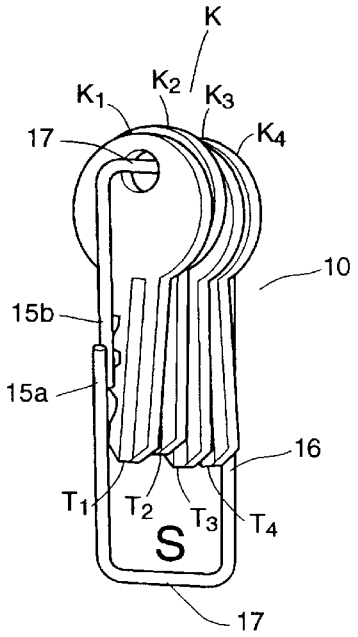
FIG. 9 is a similar view to FIG. 8 wherein the keys are contained within the space S of the key holder 10, and illustrated in a preferred embodiment of the invention.

The key holder 10 includes a space S extending between the ends 17 and 18 and the sides 15 and 16 of the holder 10. This space has an overall length of 2½" which is greater in overall length than most keys. For example, in FIG. 9, key no. 4 can be seen to be substantially less than the overall length of the distance between ends 17 and 18 of the key holder 10. Much shorter keys, such as key no. 1 and no. 2, may also be stored on the key holder 10. It is the storage of these smaller keys wherein the lap joint of FIG. 3*b* is desirable since the retainer 20 can be moved to any position to capture the ends or tails T1 through T4 of the keys K1 through K4 within the space 21 of the retainer 20 once the keys are installed on the key holder 10.

Figure 8:
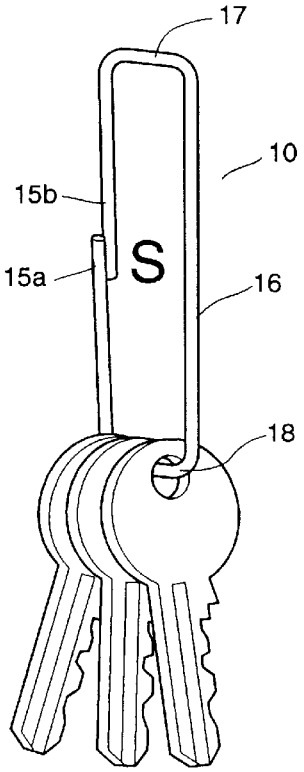
FIG. 8 is a similar view to that of FIG. 4 wherein keys are retained on the key holder illustrated in a preferred embodiment of the invention.

As best seen in FIG. 8, therefore, once the keys are installed on the key holder 10, they may be manipulated to lay flat within the space S defined between the ends 17 and 18 of the key holder 10. The keys K1 through K4 are therefore installed on the key holder through the openings in the heads of the keys by deflecting either the element 15*a* or 15*b* utilizing the key head to do so and not one's fingernails. The resilient spring steel will deflect and allow for easy insertion of the key holder 10 into the key openings. Once installed, the keys K1 through K4 assume the position in FIG. 9 at which time the key retainer is slid onto the end 18 of the key holder 10 to proximate the tails T3 and T4 until such time as the but end 15*c* engages the exterior wall proximate the end 20*b* and provides a compact package thereat wherein the keys are then stored. The overall presentation therefore of the keys is in a substantially flat bundle which may be easily stored within a pocket of trousers, a jacket or the like. This prevents the key tails T1 through T4 from progressively destroying the lining of the pocket over time. By using the flexible member 30, the key-retaining system may also be stored within a purse, briefcase, school bag or the like. Alternatively, the chain member 30 may be attached via the end 30*b* and a separate hook, not shown, to a belt loop to retain the keys of the user within the pocket or vest. The reader is advised than when a chain support is supported from the key holder 10, one key position is lost, that is to say one less key may be stored on the key holder 10. The present embodiment allows for storage of seven keys. The preferred lap joint is that illustrated in FIG. 3B since it allows the retainer 20 to cover the tails T1 and T2 of shorter keys K1 and K2.

Many changes may be made to the invention without departing from the scope thereof; it is intended that all material contained herein be interpreted as illustrative of the invention and not in a limiting sense.

The embodiments of the invention in which an exclusive property or privilege is claimed are as follows:

1. A key-retaining system comprising a key holder and a key holder retainer, said key holder comprising a quadrilateral-shaped member having two sides and two ends defined by a substantially continuous member and providing an interior space between the sides and ends of the member, said ends being separated by a predetermined distance substantially greater than the length of a key, one of said sides including an overlap joint to allow fastening of keys upon said member, said overlap joint being formed by a discontinuity in said side and including two portions having butt ends which overlap, said key holder retainer including a second member having two ends and two sides and having a hollow disposed therewith, said second member having an exterior surface, and an interior surface adjacent said hollow, the sides of the interior surface of said second member being separated by a predetermined distance substantially equal to or slightly greater than the distance between the sides of the key holder, the hollow extending substantially from end to end of the key holder retainer, wherein keys are fastened on said key holder and positioned in a flat position within the interior space between the sides of said key holder, and said key holder retainer is friction fit onto the end of the key holder remote the key heads until one of said butt ends of said overlap joint engage one end of said key holder retainer, which end acts as a stop to limit further insertion of said key holder, whereat the tail end of the keys may be contained within the hollow of said key holder retainer within the space between the sides of said key holder in a flat package which may be comfortably stored by the user.

2. The key-retaining system of claim 1 wherein said sides of said key holder extend substantially parallel to one another and said ends of said key holder extend substantially parallel to one another.

3. The key-retaining system of claim 1 wherein a groove or channel is provided proximate the sides of the key holder retainer.

4. The key-retaining system of claim 1 wherein the key holder retainer further comprises means to secure said key holder retainer against loss.

5. The key-retaining system of claim 1 wherein the key holder retainer includes an opening proximate one end thereof for fastening to a chain or other resilient element from which the key holder retainer may be secured.

6. The key-retaining system of claim 1 wherein the key holder retainer is made from thermoplastic material which readily receives a message such as advertising material on the exterior surface thereof.

* * * * *